US009025801B2

(12) United States Patent
Rauch et al.

(10) Patent No.: US 9,025,801 B2
(45) Date of Patent: May 5, 2015

(54) HEARING AID FEEDBACK NOISE ALARMS

(75) Inventors: Steven D. Rauch, Watertown, MA (US); Chris Halpin, Boston, MA (US)

(73) Assignee: Massachusetts Eye & Ear Infirmary, Boston, MA (US)

( * ) Notice: Subject to any disclaimer, the term of this patent is extended or adjusted under 35 U.S.C. 154(b) by 579 days.

(21) Appl. No.: 13/393,460

(22) PCT Filed: Aug. 31, 2010

(86) PCT No.: PCT/US2010/047343

§ 371 (c)(1),
(2), (4) Date: May 7, 2012

(87) PCT Pub. No.: WO2011/026113

PCT Pub. Date: Mar. 3, 2011

(65) Prior Publication Data

US 2012/0300963 A1 Nov. 29, 2012

Related U.S. Application Data

(60) Provisional application No. 61/238,529, filed on Aug. 31, 2009.

(51) Int. Cl.
*H04R 25/00* (2006.01)

(52) U.S. Cl.
CPC ..... *H04R 25/453* (2013.01)

(58) Field of Classification Search
USPC ..... 381/23.1, 312, 315, 318, 320, 321, 381/71.11, 71.12, 83, 93, 317
See application file for complete search history.

(56) References Cited

U.S. PATENT DOCUMENTS

| | | | | |
|---|---|---|---|---|
| 5,091,952 | A * | 2/1992 | Williamson et al. | 381/318 |
| 5,259,033 | A * | 11/1993 | Goodings et al. | 381/318 |
| 6,563,931 | B1 * | 5/2003 | Soli et al. | 381/318 |
| 2003/0053647 | A1 | 3/2003 | Kates | |
| 2007/0269068 | A1 | 11/2007 | Komagel et al. | |

FOREIGN PATENT DOCUMENTS

| | | | |
|---|---|---|---|
| EP | 0415677 | A2 | 3/1991 |
| EP | 0581261 | A1 | 2/1994 |
| EP | 0415677 | B1 | 6/1999 |
| EP | 0581261 | B1 | 9/1999 |

OTHER PUBLICATIONS

International Preliminary Report on Patentability issued on Mar. 6, 2012 for corresponding application PCT/US2010/047343.
International Search Report and Written Opinion dated Apr. 18, 2011 for corresponding application PCT/US2010/047343.

* cited by examiner

*Primary Examiner* — Huyen D Le
(74) *Attorney, Agent, or Firm* — Fish & Richardson P.C.

(57) ABSTRACT

Disclosed are methods and systems for informing a user about hearing aid feedback noise including, for example, receiving, through one or more microphones, an acoustic signal sample, analyzing the acoustic signal sample to determine whether feedback noise is present in the acoustic signal sample, and displaying to the user an indication of whether feedback noise is present in the acoustic signal sample.

17 Claims, 6 Drawing Sheets

HEARING AID FEEDBACK NOISE ALARMS

This application is the National Stage of International Application No. PCT/US2010/047343, filed on Aug. 31, 2010, which claims priority under 35 U.S.C. §119(e) to U.S. Application Ser. No. 61/238,529, filed on Aug. 31, 2009, the entire contents of which are hereby incorporated by reference.

TECHNICAL FIELD

This invention relates to systems and methods for providing hearing aid feedback noise alarms.

BACKGROUND

Many people suffer from some form of hearing loss. Hearing aid devices have provided relief for such people. However, acoustic feedback noise in hearing aid devices can draw unwanted attention to hearing aid device users and be a source of embarrassment. The feedback noise typically occurs when the gain of the hearing aid device is turned up high and/or when the hearing aid device is not properly fitted in the ear canal. This feedback noise is usually in the form of a high pitched squeal or whistle. The feedback noise can be especially annoying to people around a hearing aid device user in, for example, a concert or lecture hall. Often, the hearing aid device user is unable to hear the feedback noise. For example, a hearing aid device user may have high frequency hearing loss, and as a result is unable to hear the high pitched squeal or whistle. Consequently, in many situations, the hearing aid device user may be unaware of the annoyance being caused by the feedback noise, or unsure of which hearing aid device (left or right ear hearing aid device) is causing the feedback noise.

SUMMARY

This invention is based, at least in part, on the discovery that systems can be made to recognize the acoustic patterns of hearing aid feedback noise and to use that recognition to provide a real-time non-auditory signal, e.g., a visual (e.g., a blinking signal) and/or mechanical/tactile signal (e.g., vibrator signal) to a hearing aid user to alert the user about the feedback noise. Such systems provide a simple and economical solution to the problem of feedback noise from hearing aids that the user typically cannot hear. In some examples, the systems can be implemented as hand-held devices that the user can hold in front of him or her. If the device detects feedback noise, one or more indicator lights or other visual or tactile signal are activated to indicate which hearing aid device (left or right ear hearing aid device) is producing the feedback noise. The user can then adjust his or her hearing aid device for a tighter fit or lower its volume or make other adjustments. In this manner, the user can reduce or eliminate any concern of a squealing or whistling hearing aid causing any disturbance or interruption.

In one aspect, the invention features methods for informing a user about hearing aid feedback noise. The methods include receiving, through one or more microphones, an acoustic signal sample, analyzing the acoustic signal sample to determine whether the feedback noise is present in the acoustic signal sample, and displaying to the user an indication of whether feedback noise is present in the acoustic signal sample. In some examples, the methods also include comparing the received acoustic signal sample to a reference sample, the reference sample having one or more characteristics (e.g., frequency characteristics) of the feedback noise, and generating a signal indicating whether the acoustic signal sample matches the reference sample as the indication of whether the feedback noise is present in the acoustic signal sample.

In some embodiments, the methods also include receiving, through the one or more microphones, a first acoustic signal sample corresponding to a first hearing aid device and a second acoustic signal sample corresponding to a second hearing aid device, based on the analyzing, determining in which of the first acoustic signal sample and the second acoustic signal sample the feedback noise is present, and displaying to the user an indication of which of the first hearing aid device and the second hearing aid device produced the feedback noise.

In another aspect, the invention features devices and systems for informing a user about hearing aid feedback noise that include one or more microphones for receiving an acoustic signal sample, a processor in communication with the one or more microphones for analyzing the acoustic signal sample to determine whether feedback noise is present in the acoustic signal sample, and an indicator for indicating to the user that feedback noise has been detected.

The following are exemplary implementations. For example, the devices can also include a comparator for comparing the received acoustic signal sample to a reference sample and communicating to the indicator a signal indicating whether the acoustic signal sample matches the reference sample. In some implementations, the devices can also include a memory for storing one or more reference samples each having one or more characteristics of feedback noise.

In another aspect of the invention, machine-readable programs, e.g., computer program products stored on machine-readable storage media and devices for informing a user about hearing aid feedback noise include instructions to cause a processor, e.g., a computer, to receive, through one or more microphones, an acoustic signal sample, analyze the acoustic signal sample to determine whether the feedback noise is present in the acoustic signal sample, and display to the user an indication of whether the feedback noise is present in the acoustic signal sample. In some examples, the computer program products also include instructions to cause the computer to compare the received acoustic signal sample to a reference sample, the reference sample having one or more characteristics (e.g., frequency characteristics) of the feedback noise, and generating a signal indicating whether the acoustic signal sample matches the reference sample as the indication of whether the feedback noise is present in the acoustic signal sample. In some embodiments, the machine-readable products also include instructions to cause the computer to receive, through the one or more microphones, a first acoustic signal sample corresponding to a first hearing aid device and a second acoustic signal sample corresponding to a second hearing aid device, based on the analysis, determine in which of the first acoustic signal sample and the second acoustic signal sample the feedback noise is present, and display to the user an indication of which of the first hearing aid device and the second hearing aid device produced the feedback noise.

The invention provides several advantages. For example, the invention enables hearing aid users to attend public meetings, concerts, or lectures with the confidence that he or she is able to detect and control any feedback noise that is produced by the hearing aid and detected by the new system.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Other features and advantages of the invention will be apparent from the following detailed description, and from the claims.

DETAILED DESCRIPTION

In general, this disclosure relates to alarm systems and methods for informing hearing aid users that their hearing aid is producing feedback noise, e.g., an audible squeal, which may be disturbing others around them. The systems inform the user through a non-auditory signal, e.g., a visual (e.g., blinking light) or tactile (e.g., vibrating) signal to alert the user to the presence of feedback noise. The user, in response to being informed about the feedback noise, can immediately make one or more adjustments to, e.g., the user's head position, gain of the hearing aid, and/or fit of the hearing aid within the user's ear canal. If the hearing aid device is programmable (i.e., the hearing aid device allows the user to save settings that the user can switch to depending on the listening environment), the user can switch to a different setting in response to being informed about the feedback noise. If the above adjustments fail, as a last resort, the user can opt to remove the hearing aid to eliminate the feedback noise.

In some implementations, as described below, a hearing aid feedback noise alarm system can be implemented as a device for providing information to a hearing aid user regarding the feedback noise. In general, the hearing aid feedback noise alarm system can be implemented in analog or digital electronic circuitry, or as software, e.g., in a smart phone. These new systems do not themselves need to provide any control of the hearing aid, and thus are useful even without directly reducing the feedback noise because of the alert they provide to the hearing aid user. However, the new devices can be combined with means to control the feedback as well when used with hearing aids that provide different settings.

Hearing Aid Feedback Noise

Hearing aid feedback noise is an oscillation of an amplifier circuit within a hearing aid device. The feedback noise is caused when amplified sound from the hearing aid device escapes from inside the ear and travels around the hearing aid out of the ear and back into the hearing aid device's microphone to create a constant loop. The feedback noise can be acoustically characterized as a strong high frequency tone typically in the range of 2-4 kHz. The feedback noise is generally not a pure tone, but is accompanied by progressively less intense harmonic series at octaves.

Figure 1:
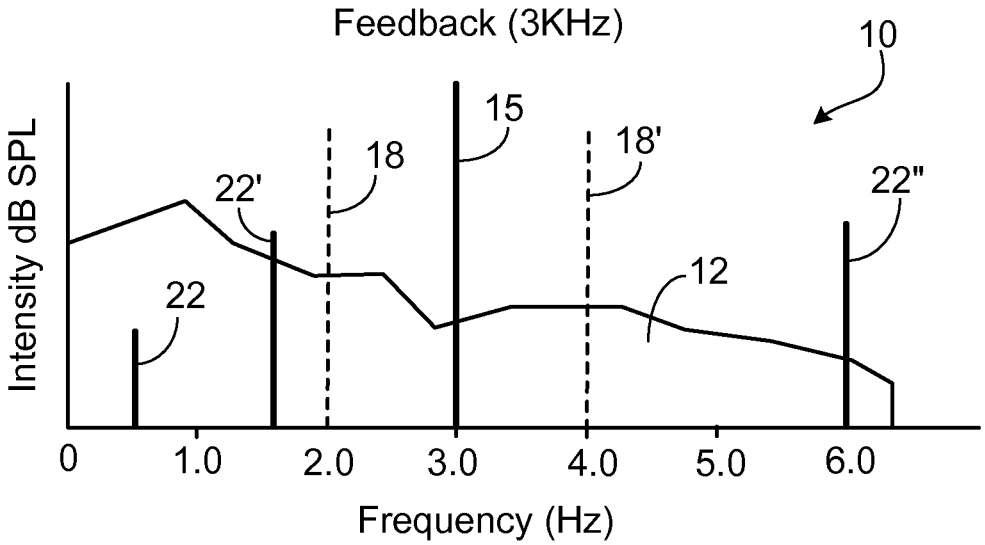
FIG. 1 is an exemplary frequency spectrum for hearing aid feedback noise.

An exemplary frequency spectrum 10 of hearing aid feedback noise is shown in FIG. 1. The spectral area 12 represents surrounding room noise. The feedback noise typically includes a main spectral energy component 15 at about 3 kHz. In some hearing aid devices, the hearing aid feedback noise can include spectral energy components ranging between components 18, 18' at 2 kHz and 4 kHz. Since the tone is not pure, i.e., sinusoidal, a harmonic series of peaks can also be expected at octaves 22, 22' and 22", e.g., at 750 Hz, 1500 Hz, and 6000 Hz.

Hearing Aid Feedback Noise Alarm Devices

Figure 2A:
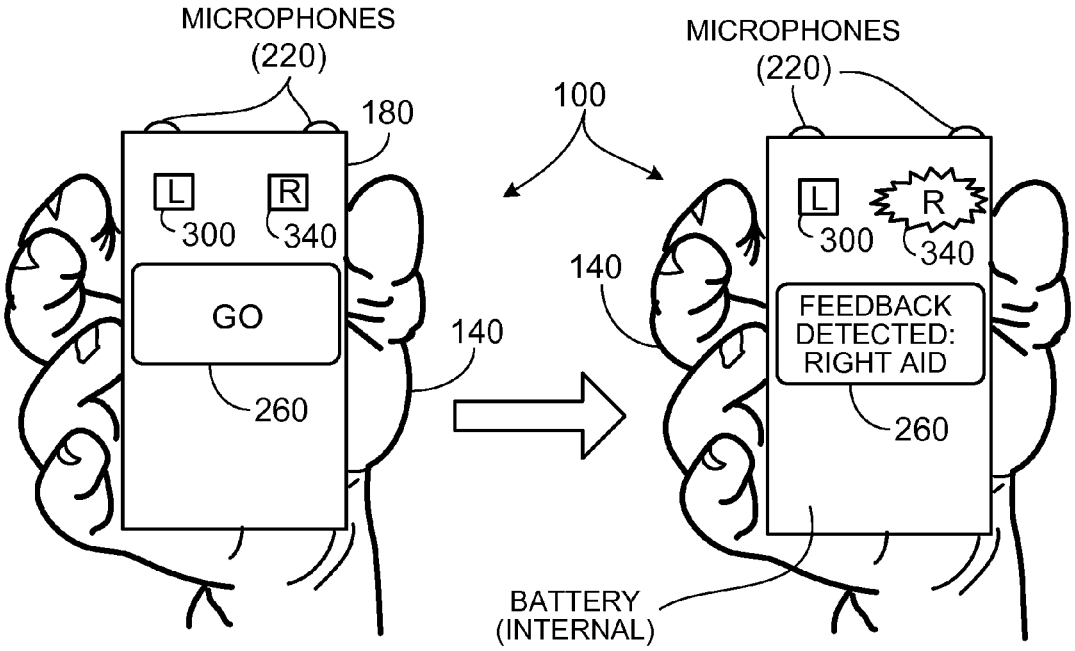
FIGS. 2A-B are schematics of exemplary hearing aid feedback noise alarm devices.
Figure 2B:
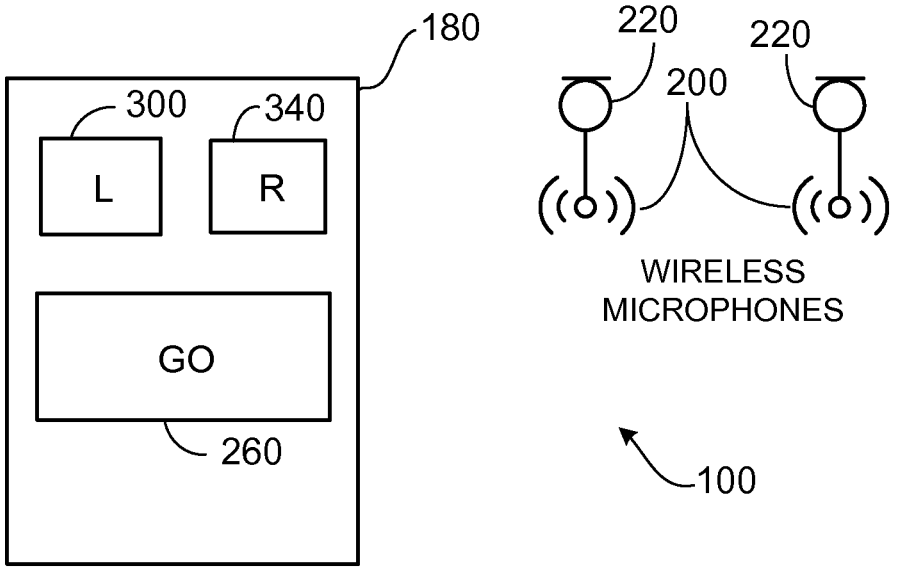

FIG. 2A shows an exemplary hearing aid feedback noise alarm system 100 for informing a user 140 about hearing aid feedback noise. The hearing aid feedback noise alarm system 100 can be implemented as a device 180 that is separate from the user's 140 hearing aid device (not shown). As shown, in some implementations, the device 180 can be a hand-held device. In some examples, the device 180 can be worn on the wrist like a watch, or be built into a watch. In some examples, the device 180 can be configured as a dedicated device solely for the purpose of informing the user 140 about the feedback noise. In some examples, the device 180 can have other purposes, and also be configured to inform the user 140 about the feedback noise. For example, the device 180 can be a smart phone (having, e.g., regular communication purposes) or a personal digital assistant (PDA), and include either digital circuitry in hardware or application modules in software for informing the hearing aid user about hearing aid feedback noise.

The device 180 can include one or more microphones 220 to pick up an acoustic signal sample, e.g., ambient noise in a concert hall including the feedback noise, if present, a display 260, and one or more indicators 300, 340 (generally 300), e.g., LED indicators, to inform the user 140 about the feedback noise. In some examples, the device 180 can also include a vibrating system (not shown) for alerting the user 140 about the feedback noise. In some examples, the device 180 can be configured to deliver ongoing notifications in the form of, e.g. vibrations, if feedback noise were to suddenly occur. In an implementation, the user 140 can be informed about the feedback noise through mechanical signals such as a tapping on the wrist or other part of the user 140.

In some examples, the number of microphones 220 is varied. For example, in one implementation, the device 180 can include a single microphone 220. In some implementations, the one or more microphones 220 can be unidirectional microphones that are sensitive to feedback noises from only one direction. As such, if the one or more microphones 220 are configured to pick up feedback noises from, e.g., the left direction, the user 140 need not locate the device 180 physically near the left hearing aid device, and may instead locate the device 180 at a neutral location, e.g., in front of the face. The one or more microphones 220 can then pick up any feedback noises from the left hearing aid device. In some examples, one or more adjustable gain stages can be added to the outputs of the one or more microphones 22 to allow variable sensitivity for best detection performance.

Referring to FIG. 1B, one or more microphones 220 can be wireless microphones having transmitters or transceivers 200 that allow the microphones 220 to communicate wirelessly with the device 180. Various wireless technologies known to those skilled in the art can be used. For example, the transceivers 200 can be radio-frequency transceivers and communicate with the device 180 using a well known standard, e.g., Bluetooth. One advantage of using wireless microphones 220 is that the device 180 can be located far away from the microphones 220, e.g., in the user's 140 pocket. The wireless microphones 220 can be attached, e.g., affixed with an adhesive, to the hearing aid device located in the user's 140 ear. This provides a simple way to retrofit existing hearing aid devices. Alternatively, the wireless microphones 220 can be easily disguised as a decorative clip, or built into or attached to earrings, the temples of eyeglasses or sunglasses, headphones, the interior or exterior of a hat, or other jewelry that can be attached to the user 140 near the hearing aid devices. This way the user 140 can opt not to hold the device 180 in his hand and may discretely be made aware of the feedback noise.

Further, in some situations, holding up the device 180 near the user's 140 ear may present a reflective surface that can provoke the hearing aid device in the user's 140 ear to generate feedback noise. Using wireless microphones 220 can eliminate this problem as the user 140 need not hold the device 180 near his ear.

The wireless microphones 220 can be powered by batteries (not shown) within the microphones 220 or located within the hearing aid device. In some implementations, the wireless microphones 220 can be remotely powered through the use of radio-frequency or infra-red signals as described in, for example, U.S. Application No. 20070105524 to Fullam et al., the contents of which are incorporated by reference herein in its entirety.

The user 140 may either be wearing only one hearing aid device in one of the ears, or a hearing aid device in each ear. If the user 140 is wearing only one hearing aid device in one of the ears, then the user 140 can use a device 180 that includes a single indicator 300 for indicating merely whether feedback noise was detected. If the user 140 is wearing a hearing aid device in each ear, then the user 140 can use a device 180 that includes the display 260 for indicating whether feedback noise was detected, and indicators 300 and 340 for indicating which hearing aid (right ear or left ear) produced the feedback noise.

In general, the user 140 may be older (e.g., over 50 years old) and more severely hearing impaired than the general population of hearing aid users. Accordingly, it can be beneficial to provide the user 140 with redundant, strong, and clear stimuli to indicate that feedback noise was detected and which hearing aid device (left or right) was the source of the feedback noise. In this regard, in some implementations, the display 260 can also display text to assist the user 140 through the process of using the device 180 properly. In some implementations, the device 140 can also include lights as indicators 300 (e.g., a red incandescent, halogen, or LED light corresponding to the right hearing aid, and a blue (or other color) light, e.g., LED light, corresponding to the left hearing aid).

In operation, when a hearing aid device user 140 is seated in e.g., a concert hall, the user 140 can hold up the device 180 in front of him, and move his head from side-to-side and also open and close his mouth. These movements typically result in feedback noise being generated by either one or both of the left and right hearing aid devices. If no feedback noise from either the left or right hearing aid devices is detected, the display 260 may display, e.g., the text "Go." If feedback noise from e.g., the right hearing aid device, is detected the display 260 may display, e.g., the text "Feedback detected: Right Aid." In some implementations, the device 180 can alert the user 140 about feedback noise only if feedback noise is detected. Otherwise, the device 180 may remain in an inert state (i.e., do nothing).

System Architecture and Operation of Hearing Aid Feedback Noise Alarm Systems

Figure 3:
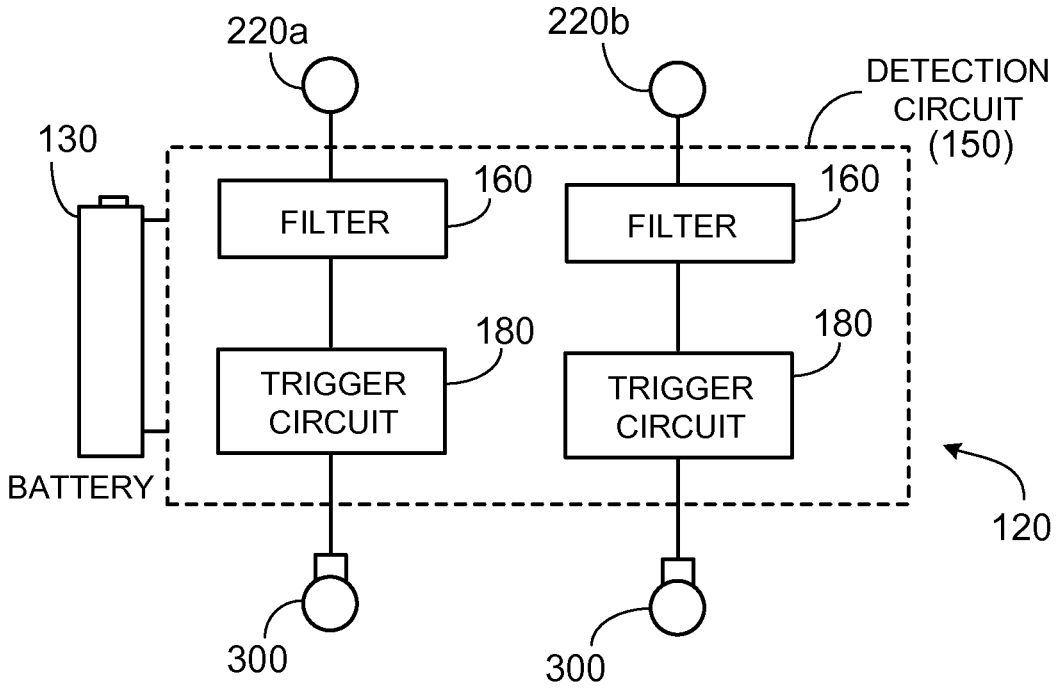
FIG. 3 is a representation of an exemplary analog circuit for a hearing aid feedback noise alarm system.

Referring to FIG. 3, in some examples, the hearing aid feedback noise alarm system 100 can be implemented in an analog circuit 120. The system 100 can be powered by a battery 130, e.g., a nine-volt PP3 battery. In some implementations, the system 100 can be powered by a battery located in the hearing aid device.

As shown, the circuit 120 includes the one or more microphones 220, and a detection circuit 150 having e.g., one or more filters 160 to exclude sounds outside the frequency range of e.g., 2-4 kHz. The detection circuit can also further include one or more triggers 180, e.g., Schmidt triggers, to engage the indicators 300 when feedback noise is above a predetermined level, e.g., 50 dB sound pressure level (SPL), is detected.

Figure 4:
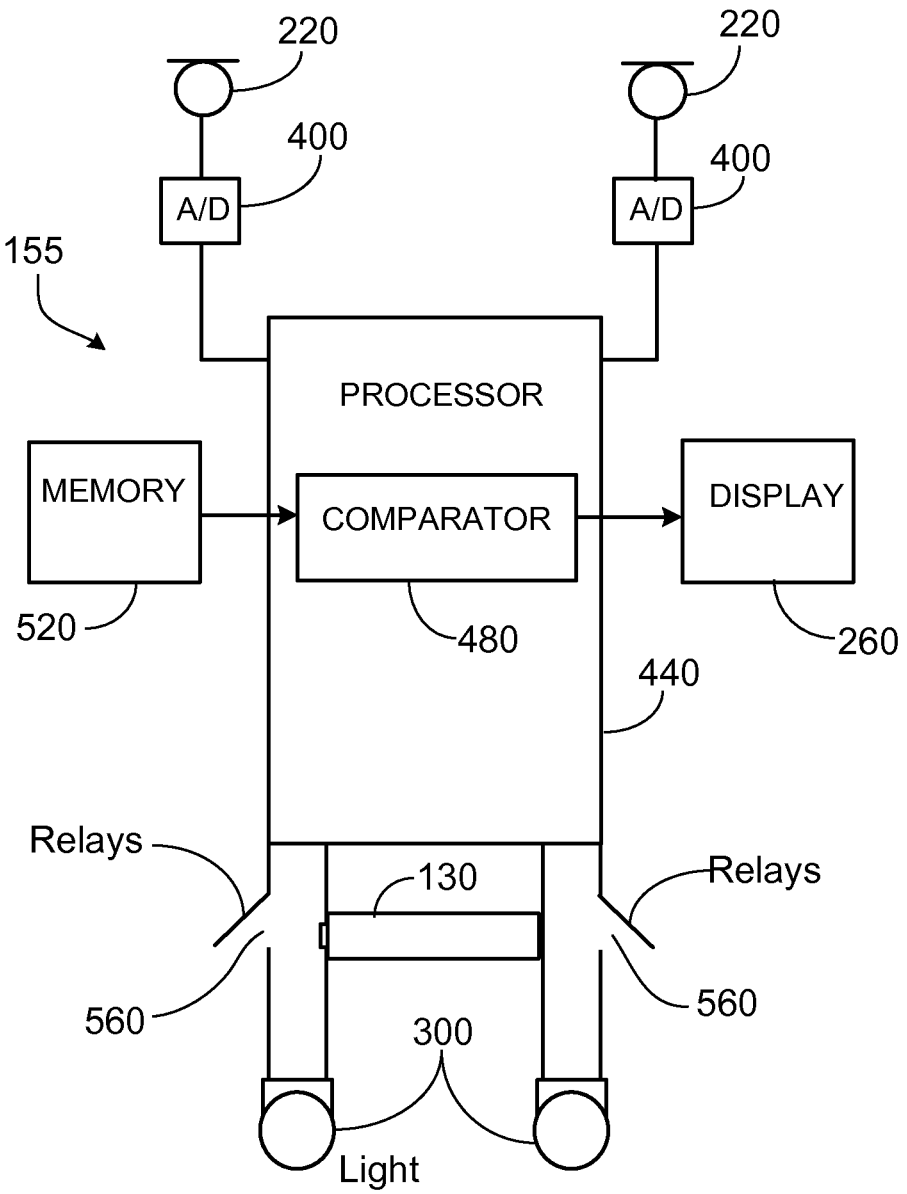
FIG. 4 is a representation of an exemplary circuit for a hearing aid feedback noise alarm system.

Referring now to FIG. 4, the hearing aid feedback noise alarm system 100 can be implemented by circuit 155 as shown. Although the system 100 is shown in FIG. 4 to be implemented using digital components, it should be understood that the components can be implemented using software modules or applications running on an operation system such as, iPhone® OS 3.0, for the iPhone, from Apple. Inc., Cupertino, Calif. Smart phones such as the iPhone may already contain basic components such as a microphone, processor, battery, and screen display and may therefore be used as a platform for a downloadable application that can inform the user 140 about the feedback noise.

The circuit 155 includes the microphones 220*a*, 220*b* (generally 220), the display 260, the indicators 300, one or more analog to digital (A/D) converters 40 in communication with the microphones 220, a processor 440 including a comparator 480, a memory 520 and relays 560 for actuating the indicators 30. The A/D converters can be, e.g., 8-bit converters for converting the analog signal received from the one or more microphones 22 into digital signals for use in the processor 440. The display 260 can be an e.g., liquid crystal display or a plasma display.

In some implementations, the processor 440 can be implemented as an integrated circuit. The processor 440 can perform a real-time fast Fourier transform (FFT) on the incoming digital signals and transform the signals from the time domain to the frequency domain.

The processor 440 can include an algorithm for reducing the effect of sounds that are incident on the microphones 220 with the same intensity and phase. For example, the processor 440 can detect a first set of signals from a first sound sample incident on a first microphone 220*a* and a second set of signals from a second sound sample incident on the second microphone 220*b* that have substantially the same intensity and phase. The first sound sample and the second sound sample are incident simultaneously on the first and second microphones 220*a*, 220*b* and carry substantially similar frequency characteristics. Accordingly, the processor 440 can reduce the effects of the first set of signals and the second set of signals as they are likely coming from common sources. An advantage of such a feature is the reduction of the effect of sounds coming from directly in front of the device 180 (i.e., the sounds are not from the user's hearing aid devices which are located in the user's ears, and are typically not both producing feedback noise at the same time).

The processor 440 can also implement an FFT change criterion to allow the processor 440 to determine the location (right or left ear hearing aid device) of source of the feedback noise. The FFT change criterion is described as follows.

As suggested above, hearing aid feedback noise can result when a reflective surface is held up near the ear. Accordingly, to evaluate the left-right location of the feedback noise, instead of holding the device 180 to their ears, the user 140 can hold the device 180 directly in front of his face, and rotate his head as if looking left and right. In doing so, the user 140 is changing the intensity of the feedback noise that is incident on the one or more microphones 220 of the device 180. The processor 440 can detect this changing intensity, and based on the change, determine which hearing aid device (left or right ear) is the source of the feedback noise. This can also help control for extraneous sounds (which would not be changing in the manner describe above). Based on the result of the FFT change criterion, the processor 440 can determine which indicator 300 (left or right) to activate for informing the user 140 about the feedback noise and the source of the feedback noise.

In some implementations, the processor 440 may cause the display 260 to provide an indication of feedback noise intensity. This can be useful to the user 140 for indicating whether the device 180 is closer or farther from the feedback noise source. For example, if the user 140 is sitting next to another hearing aid device user and it is unclear whose hearing aid device is generating the feedback noise, the indication of feedback noise intensity can be used by the user 140 to learn which hearing aid device is producing the feedback noise. For example, the user 140 can move the device 180 close to a first hearing aid device (not shown) and if the feedback noise intensity increases, the user 140 can conclude that the source of the feedback noise is the first hearing aid device.

Acoustic features of the hearing aid feedback noise spectrum (e.g., FIG. 1) can be stored as reference samples on e.g., memory 520. The memory 520 can be a Read-Only Memory (ROM). The incoming digital signals are matched to the reference signals by the comparator 480. The comparator 480 can be any digital comparator, or be implemented by e.g., software code in a programmable module. In operation, the likelihood that the incoming digital signals match the features of the reference signals, i.e., the hearing aid feedback noise spectrum (e.g., the spectrum shown in FIG. 1 above), can be quantified as, e.g., a reference-match likelihood ratio or similar calculation, with a predetermined numerical value (e.g., 2-3 s.d.) set for best detection performance. This approach can allow for more flexibility to achieve a best-performing set of predetermined criteria for both sensitivity to the presence of feedback noise and for selectivity to ignore extraneous sounds.

Process of Informing a Hearing Aid User about Feedback Noise

Figure 5:
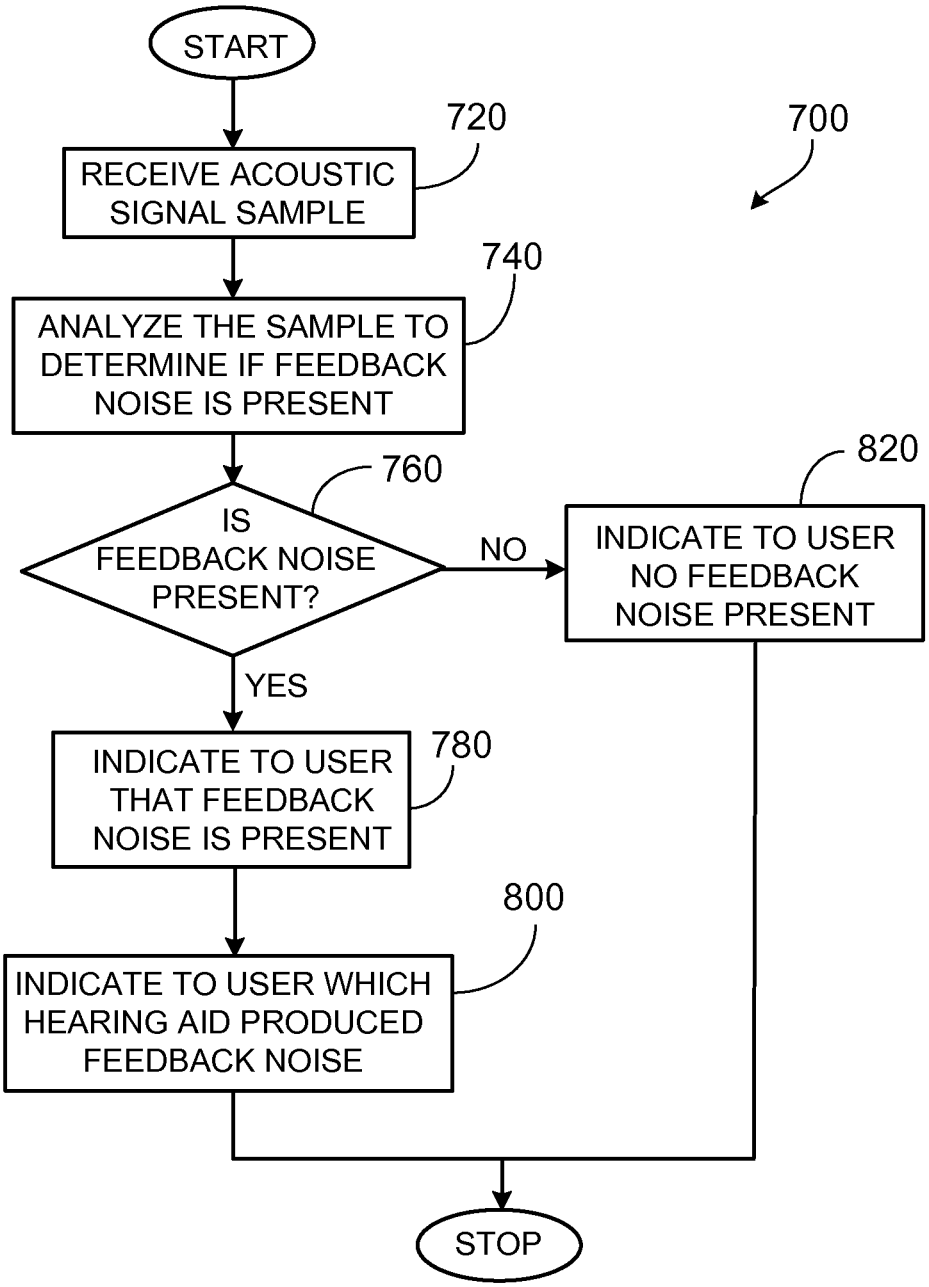
FIG. 5 is a flowchart showing exemplary steps in alerting a hearing aid user to the presence of feedback noise.

FIG. 5 shows a flowchart 700 for informing a user about hearing aid feedback noise. An acoustic signal sample is received from the one or more microphones 220 (Step 720). The acoustic signal sample is analyzed to determine if feedback noise is present in the acoustic signal sample (Steps 740-760). In some implementations, the acoustic signal sample is compared to one or more reference samples (e.g., such as FIG. 1) corresponding to known feedback noise characteristics.

If feedback noise characteristics are present in the acoustic signal sample, the user is informed that feedback noise is present in the acoustic signal sample (Step 780). In some examples, the user can also be informed about which hearing aid (left or right hearing aid) produced the feedback noise (Step 820). If the feedback noise characteristics are not present in the acoustic signal sample, the user is informed that no feedback noise is present.

In some implementations, the acoustic signal sample is analyzed to determine if one or more signals in the acoustic signal sample have magnitude above a predetermined threshold, e.g., 50 dB (SPL). If one or more signals in the acoustic signal sample is determined to exceed the predetermined threshold, then the user is informed that feedback noise was detected. The above method steps can be implemented using the hearing aid feedback noise alarm system 100 described in, for example, FIGS. 2A-B, 3 and 4.

Implementation

The techniques and systems described herein can be implemented in digital electronic circuitry, or in computer hardware, firmware, software, or in combinations thereof. The techniques can be implemented as a computer program product, i.e., a computer program tangibly embodied in an information carrier, e.g., in a machine-readable storage device or in a propagated signal, for execution by, or to control the operation of, data processing apparatus, e.g., a programmable processor, a computer, or multiple computers. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

Method steps of the techniques described herein can be performed by one or more programmable processors or computers executing a software program to perform functions described herein by operating on input data and generating output. Method steps can also be performed by, and apparatus of the invention can be implemented as, special purpose logic circuitry, e.g., an FPGA (field programmable gate array) or an ASIC (application-specific integrated circuit). Modules can refer to portions of the computer program and/or the processor/special circuitry that implements that functionality.

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Machine-readable storage devices and media suitable for embodying computer program instructions and data include all forms of non-volatile, non-transitory storage devices and media including, by way of example, semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in special purpose logic circuitry. The computing system can include clients and servers. A client and server are generally remote from each other and typically interact over a communication network. The relationship of client and server arises by virtue of computer programs running on the respective computers and having a client-server relationship to each other.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A method for informing a user about hearing aid feedback noise, the method comprising receiving samples of an acoustic signal captured using one or more microphones;

analyzing the acoustic signal based on the received samples to determine whether feedback noise is present in the acoustic signal, wherein analyzing the acoustic signal comprises:

comparing the acoustic signal to a reference signal, wherein the reference signal has one or more characteristics of feedback noise, and generating an indication signal if the acoustic signal matches the reference signal, wherein the indication signal is configured to notify a user that feedback noise is present in the acoustic signal; and providing the indication signal to the user.

2. The method of claim 1, wherein the one or more characteristics of the feedback noise includes frequency characteristics of the feedback noise.

3. The method of claim 1, wherein the received samples of the acoustic signal comprise a first acoustic signal sample corresponding to a first hearing aid device and a second acoustic signal sample corresponding to a second hearing aid device;

the analyzing includes determining in which of the first acoustic signal sample and the second acoustic signal sample the feedback noise is present; and the indication signal indicates which of the first hearing aid device and the second hearing aid device produced the feedback noise.

4. The method of claim 1, wherein the indication signal comprises at least one of a visual signal, and a tactile signal.

5. A device for informing a user about hearing aid feedback noise comprising one or more microphones for receiving an acoustic signal;

a processor in communication with the one or more microphones for analyzing samples of the acoustic signal to determine whether feedback noise is present in the acoustic signal; and an indicator in communication with the processor for indicating to the user if feedback noise is detected, wherein the device further comprises a comparator for comparing the acoustic signal with a reference signal based on the samples of the acoustic signal, and communicating to the indicator an indication signal that indicates whether the acoustic signal matches the reference signal.

6. The device of claim 5, further comprising a memory for storing one or more samples of the reference signal having one or more characteristics of feedback noise.

7. The device of claim 5, wherein the indicator comprises one or more visual or tactile signal generators.

8. The device of claim 7, wherein the one or more visual signal generators are lights.

9. The device of claim 5, wherein the processor is configured to determine, based on the received samples, whether a component of the acoustic signal has a magnitude above a predetermined threshold.

10. The device of claim 9, wherein the predetermined threshold is 50 dB.

11. A computer program product stored on a non-transitory computer readable storage device, for informing a user about hearing aid feedback noise, the computer program product comprising instructions to cause a processor to:

receive samples of an acoustic signal captured using one or more microphones;

analyze the acoustic signal based on the received samples to determine whether feedback noise is present in the acoustic signal, wherein the analysis comprises:

comparing the received acoustic signal to a reference signal, wherein the reference signal has one or more characteristics of feedback noise, and generating an indication signal if the acoustic signal sample matches the reference sample, wherein the indication signal is configured to notify a user that feedback noise is present in the acoustic signal sample; and provide the indication signal to the user.

12. The computer program product claim 11, wherein the one or more characteristics of feedback noise include frequency characteristics of feedback noise.

13. The computer program product of claim 11, wherein the received samples of the acoustic signal comprise a first acoustic signal sample corresponding to a first hearing aid device and a second acoustic signal sample corresponding to a second hearing aid device;

the analysis includes determining in which of the first acoustic signal sample and the second acoustic signal sample the feedback noise is present; and the indication signal indicates which of the first hearing aid device and the second hearing aid device produced the feedback noise.

14. The computer program product of claim 11, wherein the indication signal comprises a visual or tactile signal, or both.

15. The computer program product of claim 14, wherein the visual signal is a light.

16. The computer program product of claim 11, wherein the one or more microphones are disposed in communication with a smartphone.

17. The computer program product of claim 11, wherein the instructions are included in an application downloadable on a smartphone.

* * * * *

UNITED STATES PATENT AND TRADEMARK OFFICE

CERTIFICATE OF CORRECTION

PATENT NO. : 9,025,801 B2
APPLICATION NO. : 13/393460
DATED : May 5, 2015
INVENTOR(S) : Steven D. Rauch et al.

It is certified that error appears in the above-identified patent and that said Letters Patent is hereby corrected as shown below:

IN THE CLAIMS

In column 10, line 28 (approx.), in Claim 12, after "product" insert -- of --

Signed and Sealed this
Twenty-fourth Day of November, 2015

Michelle K. Lee

Michelle K. Lee
*Director of the United States Patent and Trademark Office*